US010181657B2

(12) United States Patent
Ai et al.

(10) Patent No.: US 10,181,657 B2
(45) Date of Patent: Jan. 15, 2019

(54) ANTENNA ARRAY, ANTENNA APPARATUS, AND BASE STATION

(71) Applicant: HUAWEI TECHNOLOGIES CO., LTD., Shenzhen, Guangdong (CN)

(72) Inventors: Ming Ai, Shenzhen (CN); Yingtao Luo, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 243 days.

(21) Appl. No.: 14/554,765

(22) Filed: Nov. 26, 2014

(65) Prior Publication Data

US 2015/0084832 A1 Mar. 26, 2015

Related U.S. Application Data

(63) Continuation of application No. PCT/CN2012/076278, filed on May 30, 2012.

(51) Int. Cl.
*H01Q 21/30* (2006.01)
*H01Q 21/06* (2006.01)
(Continued)

(52) U.S. Cl.
CPC ..... *H01Q 21/30* (2013.01); *H01Q 1/246* (2013.01); *H01Q 21/061* (2013.01); *H01Q 3/40* (2013.01);
(Continued)

(58) Field of Classification Search
CPC ..... H01Q 21/30; H01Q 1/246; H01Q 21/061; H01Q 3/40; H01Q 21/062; H01Q 21/064
See application file for complete search history.

(56) References Cited

U.S. PATENT DOCUMENTS 4,423,421 A * 12/1983 Peeler ..... H01Q 21/22 343/771
4,788,552 A * 11/1988 Karlsson ..... H01Q 21/0043 343/767
(Continued)

FOREIGN PATENT DOCUMENTS

CN 1192455 3/2005
CN 1700514 11/2005
(Continued)

OTHER PUBLICATIONS

Japanese Office Action dated Dec. 1, 2015 in corresponding Japanese Patent Application No. 2015-514315.
(Continued)

*Primary Examiner* — Jessica Han
*Assistant Examiner* — Michael Bouizza
(74) *Attorney, Agent, or Firm* — Staas & Halsey LLP

(57) ABSTRACT

Embodiments of the present invention relate to an antenna array, an antenna apparatus, and a base station. The antenna array includes: at least two antenna sub-arrays, where the at least two antenna sub-arrays are arranged in a vertical direction, each of the antenna sub-arrays includes multiple radiating elements, and in at least two adjacent antenna sub-arrays in the vertical direction, radiating elements at corresponding positions in the respective antenna sub-arrays are arranged in a staggered manner in a horizontal direction. In the embodiments of the present invention, horizontal side lobes and vertical far side lobes in an antenna array pattern are reduced, and the ultra-wideband performance is improved.

14 Claims, 14 Drawing Sheets

(51) Int. Cl.
*H01Q 1/24* (2006.01)
*H01Q 3/40* (2006.01)

(52) U.S. Cl.
CPC ..... *H01Q 21/062* (2013.01); *H01Q 21/064* (2013.01)

(56) References Cited

U.S. PATENT DOCUMENTS

| | | | | |
|---|---|---|---|---|
| 6,351,243 | B1 | 2/2002 | Derneryd et al. | |
| 2002/0101385 | A1 | 8/2002 | Huor | |
| 2004/0145526 | A1 | 7/2004 | Puente Baliarda et al. | |
| 2008/0316124 | A1* | 12/2008 | Hook | H01Q 21/061 343/705 |
| 2009/0096702 | A1* | 4/2009 | Vassilakis | H01Q 3/40 343/836 |
| 2011/0205119 | A1 | 8/2011 | Timofeev et al. | |
| 2012/0050094 | A1 | 3/2012 | Nakabayashi et al. | |

FOREIGN PATENT DOCUMENTS

| | | |
|---|---|---|
| CN | 1719661 | 1/2006 |
| CN | 201134510 | 10/2008 |
| CN | 201336371 | 10/2009 |
| CN | 201392888 | 1/2010 |
| CN | 201397879 | 2/2010 |
| CN | 102257674 | 11/2011 |
| CN | 102385053 | 3/2012 |
| JP | 11-88044 | 3/1999 |
| JP | 2000-236213 | 8/2000 |
| JP | 2003-509885 | 3/2003 |
| JP | 2005-303801 | 10/2005 |
| JP | 3812203 | 8/2006 |
| JP | 2007-259047 | 10/2007 |
| JP | 2009-159225 | 7/2009 |
| WO | WO 01/18912 | 3/2001 |

OTHER PUBLICATIONS

Chinese Office Action dated Oct. 10, 2013 in corresponding Chinese Patent Application No. 201280000882.0.
Chinese Office Action dated May 5, 2014 in corresponding Chinese Patent Application No. 201280000882.0.
PCT International Search Report dated Mar. 7, 2013 in corresponding International Patent Application No. PCT/CN2012/076278.
Huang et al., "Plane antenna arrays with randomly staggered subarrays and its optimal design", Chinese Journal of Radio Science, vol. 23, No. 5, Oct. 2008, pp. 917-921.
Extended European search report dated Mar. 23, 2015 in European Patent Application No. 12760991.5.
Chinese Office Action dated May 22, 2015 in corresponding Chinese Patent Application No. 201280000882.0.

* cited by examiner

ANTENNA ARRAY, ANTENNA APPARATUS, AND BASE STATION

CROSS-REFERENCE TO RELATED APPLICATIONS

This application is a continuation of International Application No. PCT/CN2012/076278, filed on May 30, 2012, which is hereby incorporated by reference in the entirety.

TECHNICAL FIELD

Embodiments of the present invention relate to the field of communications technologies, and in particular to an antenna array, an antenna apparatus, and a base station.

BACKGROUND

With the development of mobile communications technologies, increasingly high demands are imposed on improvements of communication system capacity, optimization of pattern performance, and the like. FIG. 1 is a schematic structural diagram of an existing antenna array, where the antenna array is comprised of five antenna sub-arrays in a vertical direction. Generally, the horizontal spacing between radiating elements in the antenna sub-array is approximately less than half of an operating wavelength, and under certain power distribution, a requirement of the antenna array for low side lobes in horizontal beams can be met.

However, in an implementation scenario where an operating frequency band of the antenna array is a wideband, the horizontal spacing between the radiating elements in the antenna sub-array cannot meet the half-wavelength requirement for each frequency point in the wideband. As a result, the energy of the horizontal side lobes in the antenna array pattern is high, and ultra-wideband performance is poor. This affects the communication system capacity.

SUMMARY

Embodiments of the present invention provide an antenna array, an antenna apparatus, and a base station to reduce energy of side lobes in horizontal beams in an antenna array pattern and improve ultra-wideband performance.

According to one aspect, an embodiment of the present invention provides an antenna array, including: at least two antenna sub-arrays, where the at least two antenna sub-arrays are arranged in a vertical direction, each of the antenna sub-arrays includes multiple radiating elements, and in at least two adjacent antenna sub-arrays in the vertical direction, radiating elements at corresponding positions in the respective antenna sub-arrays are arranged in a staggered manner in a horizontal direction.

According to another aspect, an embodiment of the present invention provides an antenna apparatus, including at least one antenna array, where the antenna array includes: at least two antenna sub-arrays, the at least two antenna sub-arrays are arranged in a vertical direction, and each of the antenna sub-arrays includes multiple radiating elements, and in at least two adjacent antenna sub-arrays in the vertical direction, radiating elements at corresponding positions in the respective antenna sub-arrays are arranged in a staggered manner in a horizontal direction.

According to still another aspect, an embodiment of the present invention provides a base station, including: an antenna apparatus, where:

the antenna apparatus includes at least one antenna array; the antenna array includes at least two antenna sub-arrays, where the at least two antenna sub-arrays are arranged in a vertical direction, and each of the antenna sub-arrays includes multiple radiating elements; and in at least two adjacent antenna sub-arrays in the vertical direction, radiating elements at corresponding positions in the respective antenna sub-arrays are arranged in a staggered manner in a horizontal direction.

According to the antenna array, the antenna apparatus, and the base station provided in the embodiments of the present invention, in the antenna array, in at least two adjacent antenna sub-arrays in a vertical direction, radiating elements at corresponding positions in the respective antenna sub-arrays are arranged in a staggered manner in the horizontal direction. This reduces the energy of horizontal side lobes in an antenna array pattern, improves the ultra-wideband performance, and increases the communication system capacity.

BRIEF DESCRIPTION OF DRAWINGS

To describe the technical solutions according to the embodiments of the present invention or in the prior art more clearly, the accompanying drawings required for describing the embodiments or the prior art are introduced below briefly. Apparently, the accompanying drawings in the following descriptions merely show some of the embodiments of the present invention, and persons of ordinary skill in the art can obtain other drawings according to the accompanying drawings without creative efforts.

DESCRIPTION OF EMBODIMENTS

The technical solutions of the present invention will be clearly and completely described in the following with reference to the accompanying drawings. It is obvious that the embodiments to be described are only a part rather than all of the embodiments of the present invention. All other embodiments obtained by persons of ordinary skill in the art based on the embodiments of the present invention without creative efforts shall fall within the protection scope of the present invention.

Figure 1:
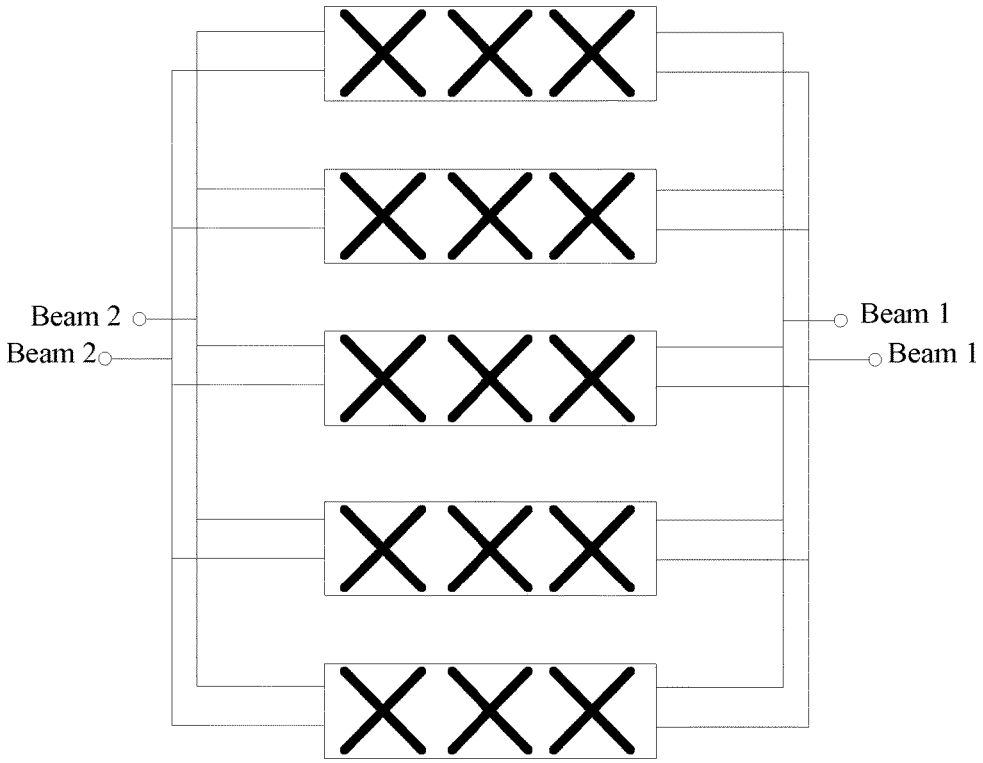
FIG. 1 is a schematic structural diagram of an existing antenna array.
Figure 2:
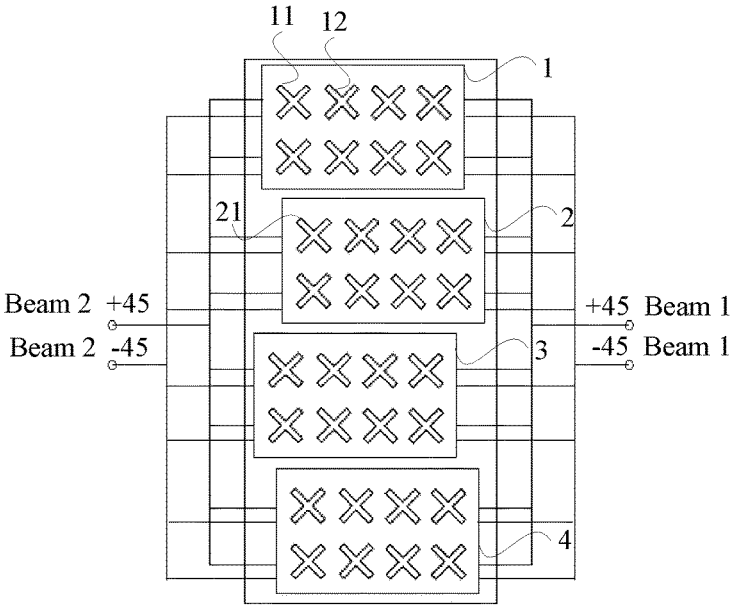
FIG. 2 is a schematic structural diagram of an antenna array according to an embodiment of the present invention.

FIG. 2 is a schematic structural diagram of an antenna array according to an embodiment of the present invention. As shown in FIG. 2, the antenna array includes:

at least two antenna sub-arrays, where the at least two antenna sub-arrays are arranged in a vertical direction, each of the antenna sub-arrays includes multiple radiating elements, and in at least two adjacent antenna sub-arrays in the vertical direction, radiating elements at corresponding positions in the respective antenna sub-arrays are arranged in a staggered manner in a horizontal direction.

The antenna array provided in this embodiment of the present invention may include a multibeam antenna array, for example, a dual-beam antenna array as shown in FIG. 2. For example, the antenna sub-arrays may be arranged in parallel. In an implementation scenario where three or more antenna sub-arrays in the antenna array are arranged in the vertical direction, the antenna sub-arrays may be arranged with equal spacing.

The antenna array as shown in FIG. 2 includes four antenna sub-arrays in the vertical direction, that is, an antenna sub-array 1, an antenna sub-array 2, an antenna sub-array 3, and an antenna sub-array 4. The antenna array provided in this embodiment is illustrated by taking an example in FIG. 2 that each of the antenna sub-arrays includes 2 rows x 4 columns of radiating elements. It can be understood that, in the antenna array provided in this embodiment of the present invention, the row number and/or the column number of the radiating elements included in each of the antenna sub-arrays may be different.

In at least two adjacent antenna sub-arrays in the vertical direction in the antenna array provided in this embodiment of the present invention, the radiating elements at corresponding positions in the respective antenna sub-arrays may be arranged in a staggered manner in the horizontal direction, so as to reduce energy of horizontal side lobes in an antenna array pattern and counteract the energy of the horizontal side lobes after synthesis of the pattern of each antenna sub-array. The radiating elements at corresponding positions in the respective antenna sub-arrays refer to the radiating elements of the same row number and the same column number in the respective antenna sub-arrays.

For example, in the antenna array as shown in FIG. 2, in a top-down direction, a radiating element 11 in the first row and the first column in the first antenna sub-array 1 and a radiating element 21 in the first row and the first column in the second antenna sub-array 2 are two radiating elements at corresponding positions. It can be seen from FIG. 2 that, the radiating element 21 in the first row and the first column in the second antenna sub-array 2 and the radiating element 11 in the first row and the first column in the first antenna sub-array 1 are not aligned in the vertical direction, whereas the radiating element 21 in the first row and the first column in the second antenna sub-array 2 is staggered rightward in the horizontal direction at a distance from the radiating element 11 in the first row and the first column in the first antenna sub-array 1.

It can be understood that, as another feasible embodiment, the radiating element 21 in the first row and the first column in the second antenna sub-array 2 may also be staggered leftward in the horizontal direction at a distance from the radiating element 11 in the first row and the first column in the first antenna sub-array 1.

Alternatively, in the at least two adjacent antenna sub-arrays in the vertical direction, at least one radiating element in one antenna sub-array may be located in the vertical direction between two radiating elements in another antenna sub-array. For example, in the antenna array as shown in FIG. 2, in the top-down direction, the radiating element 21 in the first row and the first column in the second antenna sub-array 2 is located in the vertical direction between the radiating element 11 in the first row and the first column and the radiating element 12 in the first row and the second column in the first antenna sub-array 1.

Figure 3:
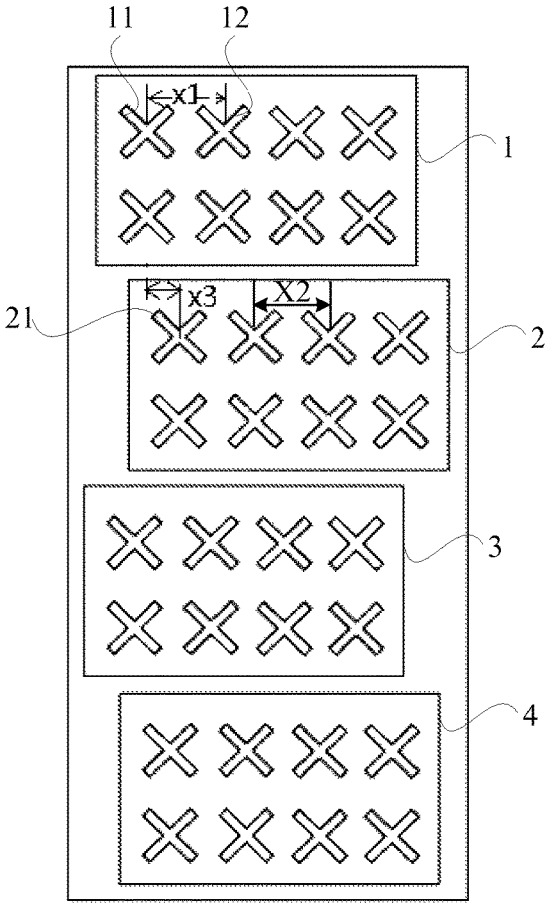
FIG. 3 is a schematic structural diagram of an antenna array according to another embodiment of the present invention.

Alternatively, in the at least two adjacent antenna sub-arrays in the vertical direction, at least one radiating element in one antenna sub-array may be located in the vertical direction in a center line of two radiating elements in another antenna sub-array. For example, in the antenna array as shown in FIG. 2, in the top-down direction, the radiating element 21 in the first row and the first column in the second antenna sub-array 2 is located in the vertical direction in a center line of the radiating element 11 in the first row and the first column in the first antenna sub-array 1 and the radiating element 12 in the first row and the second column As shown in FIG. 3, in the top-down direction, a vertical distance X3 between extension lines of the radiating element 21 in the first row and the first column in the second antenna sub-array 2 and the radiating element 11 in the first row and the first column in the first antenna sub-array 1 is equal to half of the spacing X1 between the radiating element 11 in the first row and the first column and the radiating element 12 in the first row and the second column in the first antenna sub-array 1.

Through the foregoing configuration, the energy of the horizontal side lobes after synthesis of the pattern of each antenna sub-array may be counteracted, thereby improving the ultra-wideband performance of the antenna array and increasing the communication system capacity.

Figure 4:
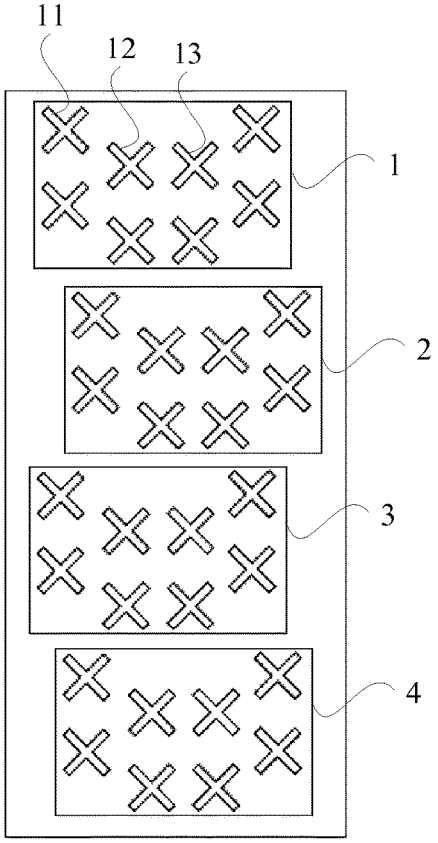
FIG. 4 is a schematic structural diagram of an antenna array according to still another embodiment of the present invention.

FIG. 4 is a schematic structural diagram of an antenna array according to another embodiment of the present invention. As shown in FIG. 4, based on the foregoing embodiment, alternatively, in at least one antenna sub-array of the antenna array, at least two adjacent radiating elements in a horizontal direction may be arranged in a staggered manner in a vertical direction.

In the antenna array as shown in FIG. 4, in a first antenna sub-array 1 in a top-down direction, a radiating element 12 in the first row and the second column is staggered downward in the vertical direction at a distance from a radiating element 11 in the first row and the first column, is not staggered in the vertical direction from a radiating element 13 in the first row and the third column, and is aligned with the radiating element 13 in the first row and the third column in the horizontal direction.

Figure 5:
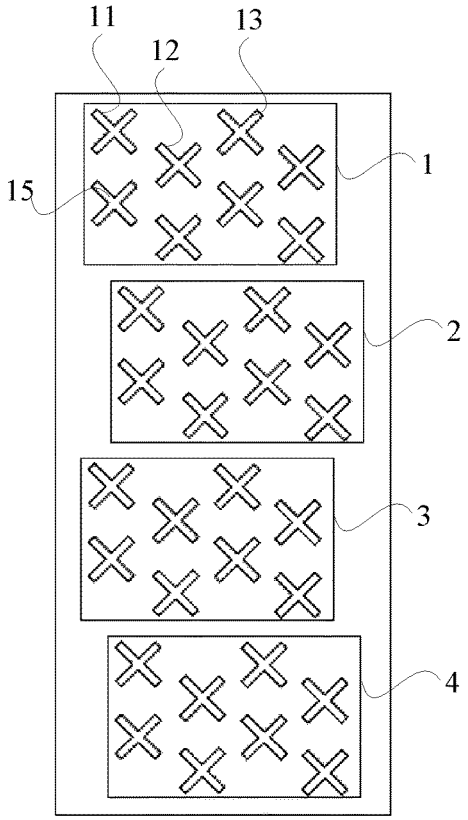
FIG. 5 is a schematic structural diagram of an antenna array according to still another embodiment of the present invention.

In an antenna array as shown in FIG. 5, in a first antenna sub-array 1 in the top-down direction, a radiating element 12 in the first row and the second column is staggered downward in the vertical direction at a distance from a radiating element 11 in the first row and the first column, and is further staggered downward in the vertical direction at a distance from a radiating element 13 in the first row and the third column.

It should be noted that each of the antenna sub-arrays includes 2 rows×4 columns of radiating elements in FIG. 4 and FIG. 5, which is taken as an example for illustrating the antenna array provided in this embodiment. It can be understood that, in the antenna array provided in this embodiment, the row number and/or column number of the radiating elements included in each of the antenna sub-arrays may be different.

Alternatively, in at least one antenna sub-array, at least one radiating element may be located in the horizontal direction between two adjacent radiating elements in the vertical direction. For example, in the antenna array as shown in FIG. 5, in the first antenna sub-array 1 in the top-down direction, the radiating element 12 in the first row and the second column is located in the horizontal direction between the radiating element 11 in the first row and the first column and the radiating element 15 in the second row and the first column.

Alternatively, in at least one antenna sub-array, at least one radiating element may be located in the horizontal direction in a center line of two adjacent radiating elements in the vertical direction. For example, in the antenna array as shown in FIG. 5, in the first antenna sub-array 1 in the top-down direction, the radiating element 12 in the first row and the second column is located in the horizontal direction in a center line of the radiating element 11 in the first row and the first column and the radiating element 15 in the second row and the first column.

Through the foregoing configuration, on the basis that the energy of the horizontal side lobes in the antenna array pattern is reduced, the energy of vertical far side lobes after synthesis of the pattern of each antenna sub-array may be counteracted, thereby improving the ultra-wideband performance of the antenna array and increasing the communication system capacity.

Based on the foregoing embodiment, alternatively, adjacent antenna sub-arrays in the vertical top-down direction may be alternately arranged in a staggered manner in different horizontal directions. For example, in the antenna arrays as shown in FIG. 2 to FIG. 5, in a first group of adjacent antenna sub-arrays in the vertical top-down direction, that is, the antenna sub-array 1 and the antenna sub-array 2, the second antenna sub-array 2 is staggered rightward in the horizontal direction from the antenna sub-array 1. In a second group of adjacent antenna sub-arrays in the vertical top-down direction, that is, the antenna sub-array 2 and the antenna sub-array 3, the antenna sub-array 3 is staggered leftward in the horizontal direction from the antenna sub-array 2.

Based on the foregoing embodiment, alternatively, the spacing between adjacent radiating elements in at least one antenna sub-array may be equal to the spacing between adjacent radiating elements in another antenna sub-array adjacent to the foregoing antenna sub-array in the vertical direction. For example, in the antenna array as shown in FIG. 3, in the vertical top-down direction, assuming that the spacing between adjacent radiating elements in the first antenna sub-array 1 is X1 and the spacing between adjacent radiating elements in the second antenna sub-array 2 is X2, it may be set that X1=X2.

Figure 6:
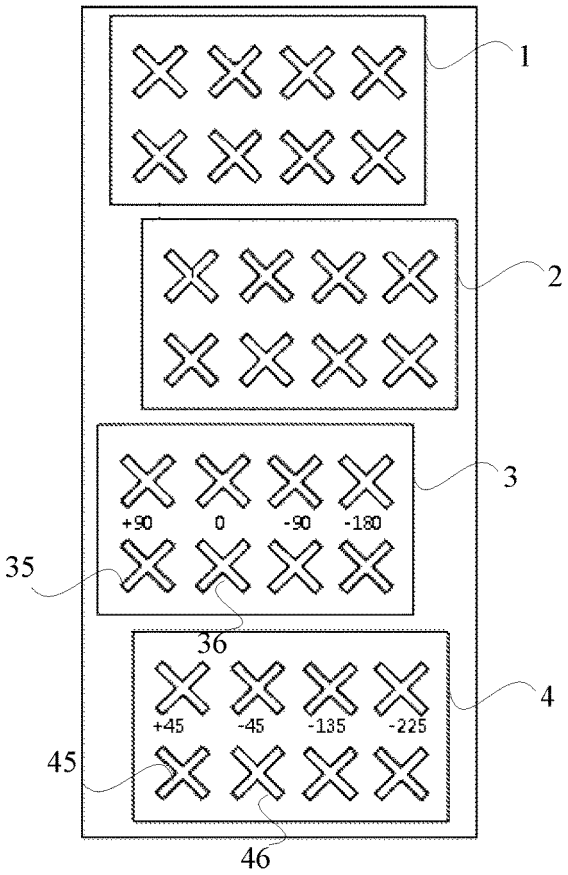
FIG. 6 is a schematic structural diagram of an antenna array according to still another embodiment of the present invention.

In the antenna array pattern, alternatively, a phase difference of 45° may exist between a signal input into a radiating element in at least one antenna sub-array and a signal input into a radiating element at a corresponding position in another antenna sub-array adjacent to the foregoing antenna sub-array in the vertical direction so as to further reduce the vertical far side lobes. As shown in FIG. 6, in the vertical top-down direction, the phase of a signal input into a radiating element 35 in the second row and the first column in a third antenna sub-array 3 is +90°, and the phase of a signal input into a radiating element 45 in the second row and the first column in a fourth antenna sub-array 4 is +45°; the phase of a signal input into a radiating element 36 in the second row and the second column in the third antenna sub-array 3 is 0°, and the phase of a signal input into the radiating element 46 in the second row and the second column in the fourth antenna sub-array 4 is −45°, and so on.

Figure 7:
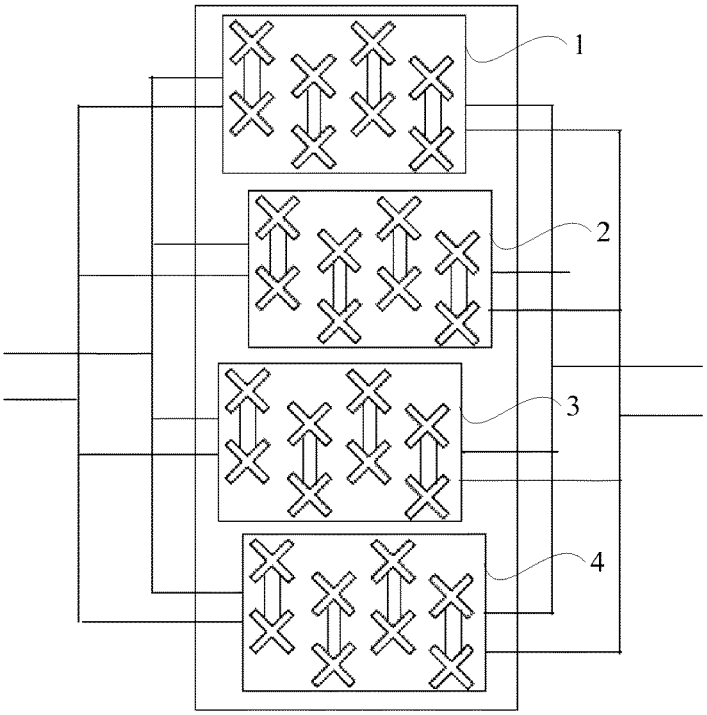
FIG. 7 is a schematic structural diagram of an antenna array according to still another embodiment of the present invention.

Alternatively, in at least one antenna sub-array, radiating elements located in a same column may be electrically connected, and/or radiating elements located in a same row may be electrically connected so as to simplify the feeder connection of the antenna array. FIG. 7 shows an implementation scenario where radiating elements in a same column are electrically connected in an antenna sub-array 1, an antenna sub-array 2, an antenna sub-array 3 and an antenna sub-array 4.

Figure 8:
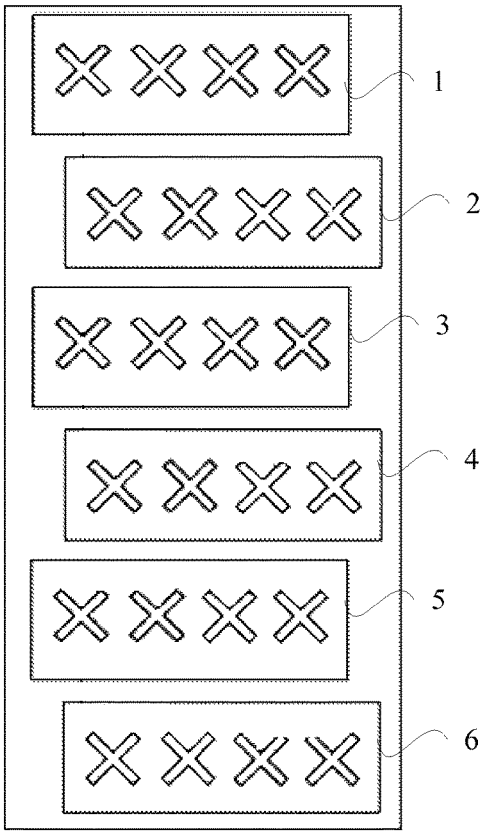
FIG. 8 is a schematic structural diagram of an antenna array according to still another embodiment of the present invention.

As a feasible implementation manner, in each of the antenna sub-arrays in the antenna array provided in this embodiment of the present invention, the number of radiating elements in each row may be equal, and the number of radiating elements in each column also may be equal. FIG. 2 to FIG. 7 show implementation scenarios where the antenna sub-array 1, the antenna sub-array 2, the antenna sub-array 3, and the antenna sub-array 4 all include 2 rows×4 columns of radiating elements. For another example, FIG. 8 shows an implementation scenario where an antenna sub-array 1 to an antenna sub-array 6 all include 1 row×4 columns of radiating elements.

Figure 9:
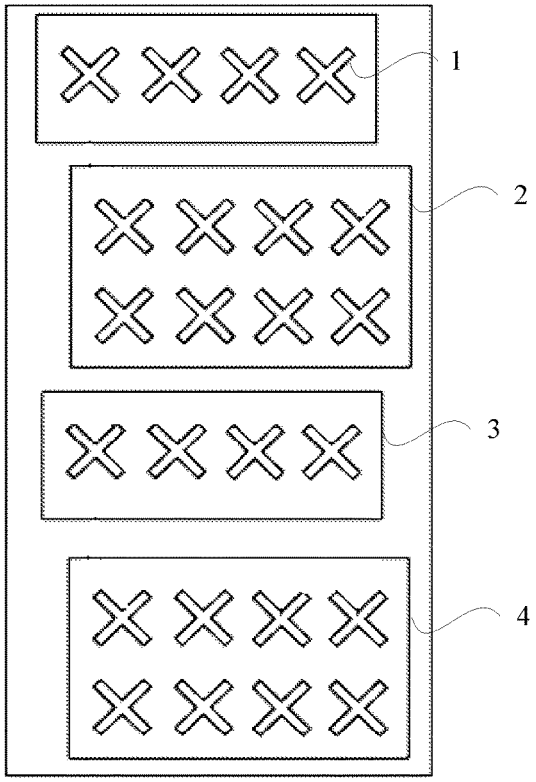
FIG. 9 is a schematic structural diagram of an antenna array according to still another embodiment of the present invention.

As another feasible implementation manner, in the antenna array provided in this embodiment of the present invention, at least two antenna sub-arrays may include at least two types of antenna sub-arrays, each type of the antenna sub-array may include m rows×n columns of radiating elements, and m and/or n in different antenna sub-arrays may be unequal, where m and n are both integers greater than one. For example, an antenna array as shown in FIG. 9 includes two types of antenna sub-arrays, where an antenna sub-array 1 and an antenna sub-array 3 are antenna sub-arrays of a same type, which include 1 row×4 columns of radiating elements, and an antenna sub-array 2 and an antenna sub-array 4 are antenna sub-arrays of another type, which include 2 rows×4 columns of radiating elements.

Alternatively, at least two types of antenna sub-arrays may be alternately arranged in the vertical direction. As shown in FIG. 9, in the vertical top-down direction, the antenna sub-array 1 and the antenna sub-array 3 of the same type are alternately arranged with the antenna sub-array 2 and the antenna sub-array 4 of another type.

The present invention further provides an antenna apparatus according to an embodiment. The antenna apparatus may include: at least one antenna array.

The antenna array includes: at least two antenna sub-arrays, where the at least two antenna sub-arrays are arranged in a vertical direction, each of the antenna sub-arrays includes multiple radiating elements, and in at least two adjacent antenna sub-arrays in the vertical direction, radiating elements at corresponding positions in the respective antenna sub-arrays are arranged in a staggered manner in a horizontal direction.

The antenna apparatus may include a beamforming network, configured to adjust the phase and the amplitude of a signal transmitted by the antenna array. For example, in an implementation scenario where the antenna array includes two types of antenna sub-arrays, two beamforming networks may be configured in the antenna apparatus. One beamforming network may feed one type of the antenna sub-array so as to adjust the phase and the amplitude of a signal transmitted by this type of the antenna sub-array, thereby enabling the signal transmitted by the antenna sub-array to have the preset amplitude and phase. In addition, the other beamforming network may feed the other type of the antenna sub-array so as to adjust the phase and the amplitude of a signal transmitted by this type of the antenna sub-array, thereby enabling the signal transmitted by the antenna sub-array to have the preset amplitude and phase. These two beamforming networks may be connected through devices such as a power splitter or a phase shifter. For a specific structure and a function of the antenna array, reference may be made to the embodiment of the antenna array provided in the present invention. Therefore, no further details are provided herein.

Figure 10:
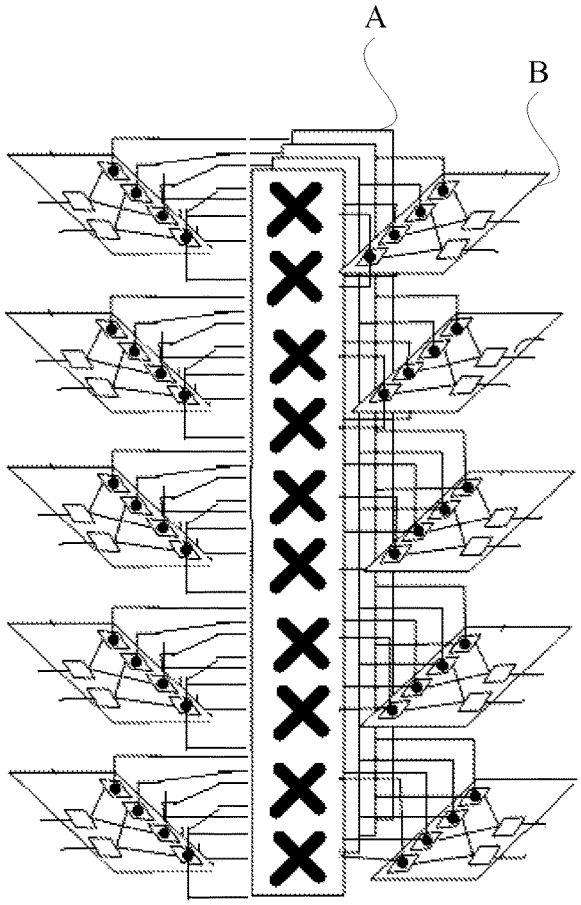
FIG. 10 is a schematic structural diagram of an antenna apparatus according to an embodiment of the present invention.
Figure 11:
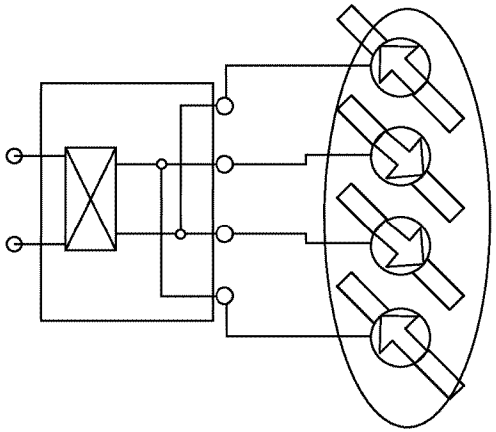
FIG. 11 is a schematic structural diagram of a beamforming network in the antenna apparatus as shown in FIG. 10.
Figure 12:
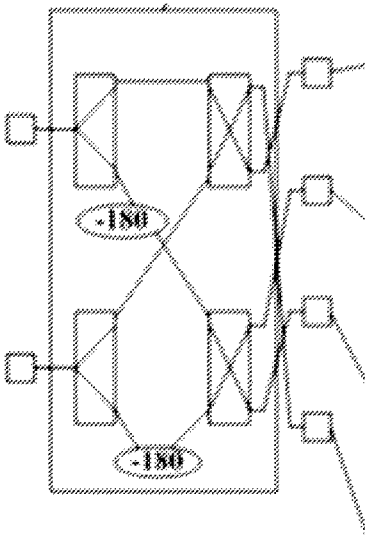
FIG. 12 is a schematic structural diagram of another beamforming network in the antenna apparatus as shown in FIG. 10.

FIG. 10 is a schematic structural diagram of the antenna apparatus according to an embodiment. As shown in FIG. 10, the antenna apparatus may include multiple antenna arrays A, among which at least one inverter array may be included. The feeding phase of the inverter array is opposite to the feeding phase of any other antenna array A. The inverter array performs inversion processing for the phase of a transmitted signal, and the inverter array and a beamforming network B together enable the signal transmitted by the inverter array to have the preset phase. FIG. 11 is a schematic structural diagram of a beamforming network in the antenna apparatus as shown in FIG. 10, and FIG. 12 is a schematic structural diagram of another beamforming network in the antenna apparatus as shown in FIG. 10. The structures of the beamforming networks as shown in FIG. 11 and FIG. 12 are both existing structures whose principles are not described herein again.

According to the antenna apparatus provided in this embodiment of the present invention, in at least two adjacent antenna sub-arrays in a vertical direction in an antenna array, radiating elements at corresponding positions in the respective antenna sub-arrays are arranged in a staggered manner in a horizontal direction. This reduces the energy of horizontal side lobes in an antenna array pattern, improves the ultra-wideband performance, and increases the communication system capacity.

The present invention further provides a base station according to an embodiment, including an antenna apparatus.

The antenna apparatus may include: at least one antenna array.

The antenna array includes: at least two antenna sub-arrays, where the at least two antenna sub-arrays are arranged in a vertical direction, each of the antenna sub-arrays includes multiple radiating elements, and in at least two adjacent antenna sub-arrays in the vertical direction, radiating elements at corresponding positions in the respective antenna sub-arrays are arranged in a staggered manner in a horizontal direction.

Figure 13:
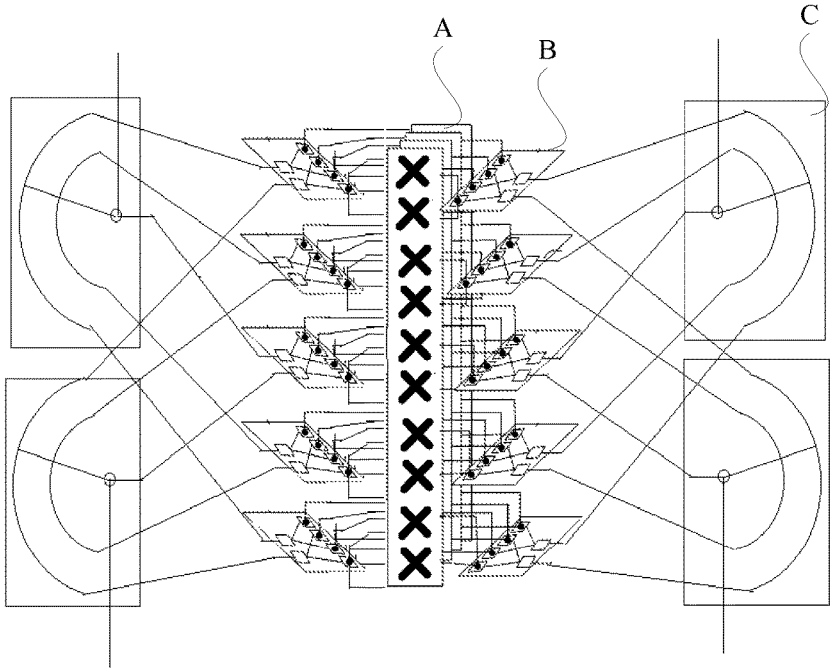
FIG. 13 is a schematic structural diagram of a base station according to an embodiment of the present invention.

FIG. 13 is a schematic structural diagram of the base station according to an embodiment of the present invention. As shown in FIG. 13, an antenna apparatus of the base station may include: at least one antenna array A, at least one beamforming network B, and at least one phase shifter C, where the beamforming network B is configured to adjust the phase and the amplitude of a signal transmitted by the antenna array; and the phase shifter C is configured to adjust a downtilt angle of the antenna apparatus.

According to the base station provided in this embodiment of the present invention, in at least two adjacent antenna sub-arrays in a vertical direction in an antenna array, radiating elements at corresponding positions in the respective antenna sub-arrays are arranged in a staggered manner in a horizontal direction. This reduces the energy of horizontal side lobes in an antenna array pattern, improves the ultra-wideband performance, and increases the communication system capacity.

Figure 14:
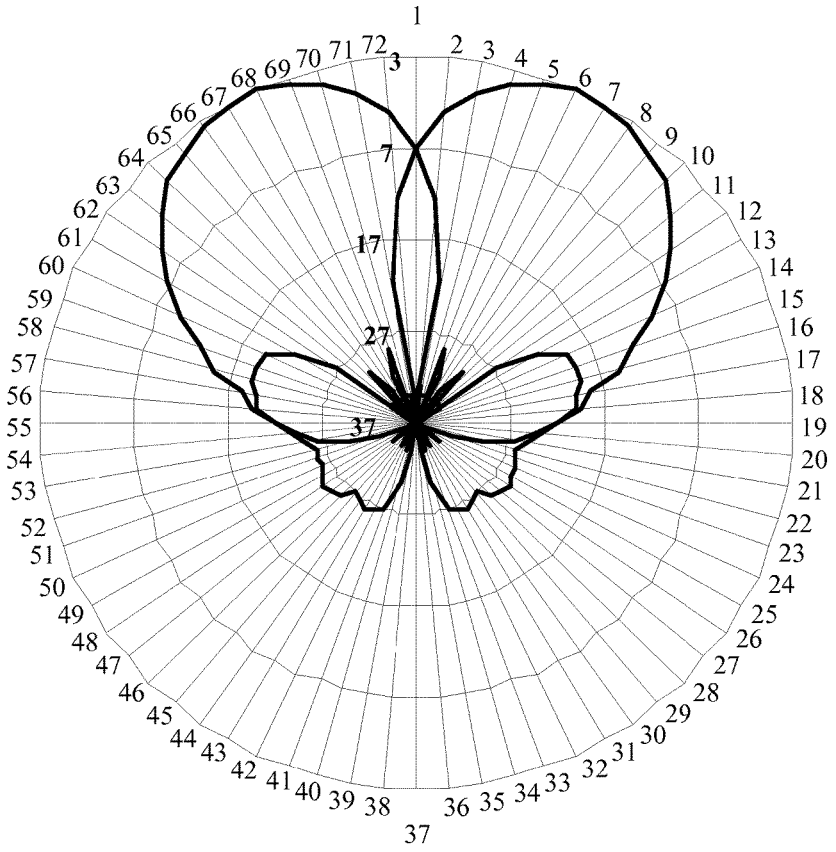
FIG. 14 is a horizontal pattern of the existing antenna array.
Figure 15:
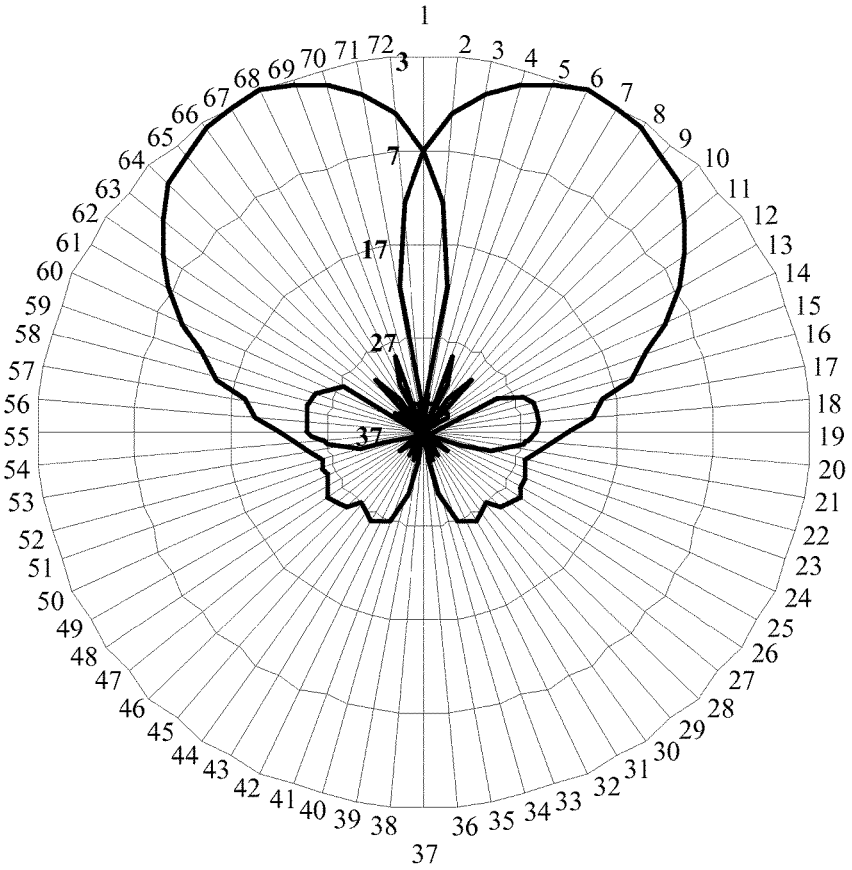
FIG. 15 is a horizontal pattern of the antenna array according to an embodiment of the present invention.

With the increasing growth of the number of users, the communication system needs to add base stations to expand the system capacity, for example, 6-sector network construction may be used to expand the system capacity without adding any station, and it is a preferred method to adopt a multibeam antenna to expand the system capacity. The antenna array and the antenna apparatus provided in the embodiments of the present invention are applicable to a multibeam application scenario, and the antenna apparatus in the base station provided in the embodiment of the present invention is applicable to the multibeam application scenario. Compared with the pattern of the existing multibeam antenna array as shown in FIG. 14, the pattern of the antenna array provided in the present invention as shown in FIG. 15 has lower energy in the horizontal side lobes.

Finally, it should be noted that the above embodiments are merely provided for describing the technical solutions of the present invention, but not intended to limit the present invention. It should be understood by persons of ordinary skill in the art that although the present invention has been described in detail with reference to the embodiments, modifications can be made to the technical solutions described in the embodiments, or equivalent replacements can be made to some technical features in the technical solutions, as long as such modifications or replacements do not cause the essence of corresponding technical solutions to depart from the spirit and scope of the present invention.

What is claimed is:

1. An antenna array, comprising:

a plurality of antenna sub-arrays, wherein at least two of the plurality of antenna sub-arrays are arranged in a vertical direction, each of the antenna sub-arrays among the plurality of antenna sub-arrays comprising multiple radiating elements arranged in at least n columns with a same number of radiating elements in each column for any given antenna sub-array, n being a positive integer, and in at least two adjacent antenna sub-arrays in the vertical direction from among the plurality of antenna sub-arrays, the columns of radiating elements at corresponding positions in the respective antenna sub-arrays are arranged in a staggered manner in a horizontal direction, wherein:

at least one antenna sub-array among the plurality of antenna sub-arrays includes two radiating elements per column, antenna sub-arrays other than the at least one antenna sub-array includes either one or two radiating elements per column, and the antenna array is one of multiple antenna arrays, and at least one of the multiple antenna arrays is an inverter array.

2. The antenna array according to claim 1, wherein in the at least two adjacent antenna sub-arrays in the vertical direction, at least one column of radiating elements in one antenna sub-array is located in the vertical direction between two adjacent columns of radiating elements in another antenna sub-array.

3. The antenna array according to claim 2, wherein in the at least two adjacent antenna sub-arrays in the vertical direction, at least one column of radiating elements in one antenna sub-array is located in the vertical direction in a center line of two adjacent columns of radiating elements in another antenna sub-array.

4. The antenna array according to claim 1, wherein in at least one antenna sub-array, at least two adjacent columns of radiating elements in the horizontal direction are arranged in a staggered manner in the vertical direction.

5. The antenna array according to claim 4, wherein in at least one antenna sub-array, at least one radiating element is located in the horizontal direction between two adjacent radiating elements in the vertical direction.

6. The antenna array according to claim 5, wherein in at least one antenna sub-array, at least one radiating element is located in the horizontal direction in a center line of two adjacent radiating elements in the vertical direction.

7. The antenna array according to claim 1, wherein adjacent antenna sub-arrays in a vertical top-down direction are alternately arranged in a staggered manner in different horizontal directions.

8. The antenna array according to claim 1, wherein a first spacing between horizontally adjacent radiating elements in at least one antenna sub-array is equal to a second spacing between horizontally adjacent radiating elements in another antenna sub-array adjacent to the foregoing antenna sub-array in the vertical direction.

9. The antenna array according to claim 1, wherein a phase difference of 45° exists between a signal input into a radiating element of an m-th column in at least one antenna sub-array and a signal input into an radiating element of the m-th column in another antenna sub-array adjacent to the foregoing antenna sub-array in the vertical direction.

10. The antenna array according to claim 1, wherein in at least one antenna sub-array, radiating elements located in a same column are electrically connected, and/or radiating elements located in a same row are electrically connected.

11. The antenna array according to claim 1, wherein in each of the antenna sub-arrays, the number of radiating elements in each row is equal.

12. The antenna array according to claim 1, wherein at least two antenna sub-arrays comprise at least two types of antenna sub-arrays, each type of the antenna array comprises m rows ×p columns of radiating elements, and m and/or p in different antenna sub-arrays types are unequal, wherein m and p are both integers greater than one.

13. The antenna array according to claim 1, wherein the plurality of antenna sub-arrays is substantially planar.

14. The antenna array according to claim 1, wherein each of the plurality of antenna sub-arrays is in a plane.

* * * * *